United States Patent [19]

Ludwick

[11] Patent Number: 4,522,381

[45] Date of Patent: Jun. 11, 1985

[54] ONE PIECE SANITARY DIAPER CHANGING STATION

[76] Inventor: Lanny E. Ludwick, 1005 12th St., Huntington Beach, Calif. 92648

[21] Appl. No.: 505,454

[22] Filed: Jun. 17, 1983

[51] Int. Cl.[3] ..... A61G 13/00

[52] U.S. Cl. ..... 269/328

[58] Field of Search ..... 269/328; 224/158; 206/558, 564, 565; 5/81, 92; 128/134

[56] References Cited

U.S. PATENT DOCUMENTS

| | | | |
|---|---|---|---|
| 2,973,889 | 3/1961 | Phillips | 269/328 |
| 2,974,322 | 3/1961 | Norris | 5/92 |
| 3,656,193 | 4/1972 | Alterberg | 5/92 |
| 3,721,434 | 3/1973 | Spies | 269/328 |
| 3,779,540 | 12/1973 | Boudreau | 269/328 |

FOREIGN PATENT DOCUMENTS

| | | | |
|---|---|---|---|
| 2927310 | 7/1980 | Fed. Rep. of Germany | 5/92 |
| 1466464 | 1/1967 | France | 5/92 |

*Primary Examiner*—Robert C. Watson

*Attorney, Agent, or Firm*—Collins & Croteau

[57] ABSTRACT

A rigid one piece two compartmented container to provide an easily transportable and sanitary diaper changing surface for infants. The device has a one piece rectangular flat based tray having two adjoining sections, one section has angled sides and a flat base surface to hold an infant during the diaper changing process and the other section is a compartment to hold the diaper changing accessories. A non-porous vinyl covered foam rubber pad fits over the flat base of the diaper changing surface. A safety strap with conventional adjusting hardware and a simple attaching device is provided to safely secure the infant on the diaper changing surface.

2 Claims, 4 Drawing Figures

ONE PIECE SANITARY DIAPER CHANGING STATION

FIELD OF INVENTION

The present invention relates to a device on which an infants diaper may be easily, sanitarily, safely and conveniently changed. A highly mobile sanitary diaper changing device consisting of both a diaper changing section and a container section to hold and secure the necessay changing accessories (lotions, powder, oil, towelettes, cottonballs, pins, etc.).

DESCRIPTION OF PRIOR ART

Due to the type of furnishings used in homes, apartments and motel or hotel rooms it is difficult to provide a sanitary, convenient and secure surface on which to place an infant while changing diaper. The easily soiled furnishings prevalent in these houses makes it desirable to provide a means that could eliminate these surfaces from coming in contact with the infant or with human waste. Currently available infant or child carriers do not provide surfaces properly shaped. Cribs or bassinets available require substantial space and are cumbersome and not easily transported. Other surfaces do not provide a secure surface or a surface that isolates and prevents the dripping of waste.

It is therefore desirable that an inexpensive and effective diaper changing aid be available.

SUMMARY

The primary object of the present invention is to provide a simple, inexpensive diaper changing aid that provides a safe, convenient, sanitary and easily moved diaper changing aid. Another object of the present invention is to overcome the disadvantages of prior inventions.

In accordance with the object and scope of the present invention, the invention is a diaper changing aid that includes two sections, a generally flat planar section having angled sidewalls to prevent the rolling or sliding of the infant and a section that provides a compartment for the holding of articles needed during the diaper changing process. The two section may be made of one piece of rigid material such as plastic or may consist of two parts with the compartment for holding articles attached either permanently or temporarily. A raised edge or lip is provided on each side of the flat plannar section not having an angled sidewall sufficiently high to contain liquid waste that may occur during the diaper changing process.

DESCRIPTION OF THE PREFERRED EMBODIMENT

Figure 1:
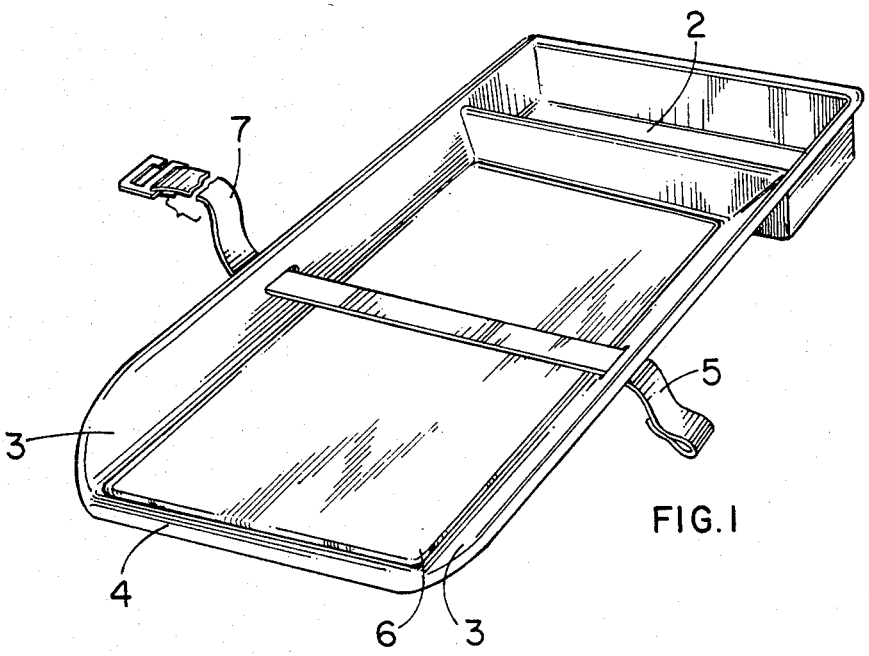
FIG. 1 is a perspective view of the device.
Figure 3:
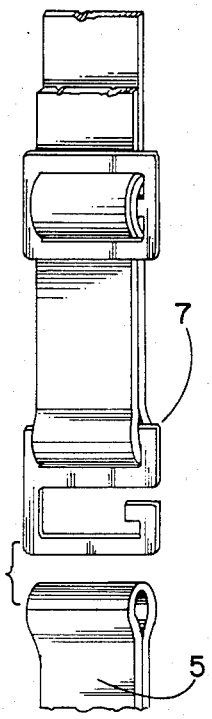
FIG. 3 is a perspective view of typical security strap.
Figure 2:
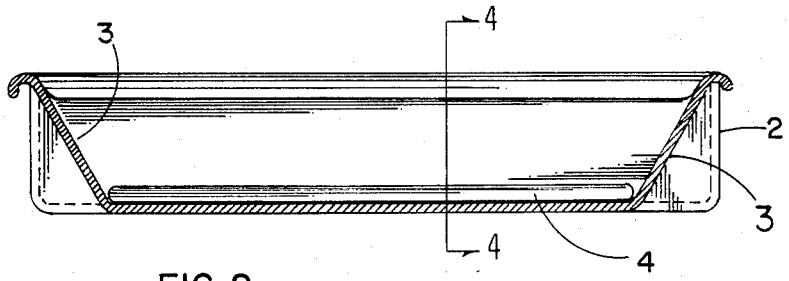
FIG. 2 is an end view of device.
Figure 4:
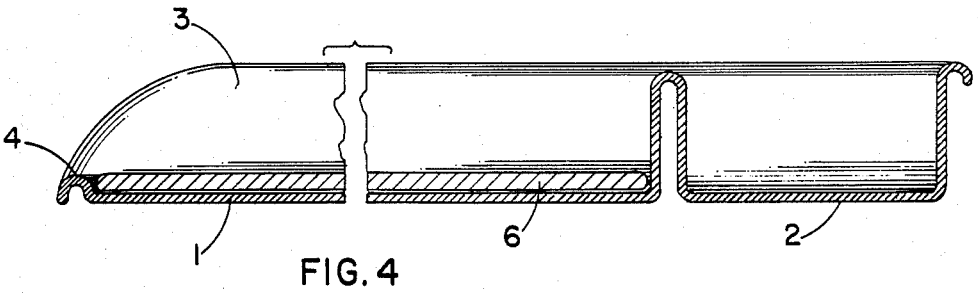
FIG. 4 is a side view of the device.

Referring to the drawing, there is shown a device comprising of a rigid one piece material having two sections. The material may be plastic, metal, wood or other suitable material. One of the sections has a flat planar rectangular surface (1) with sidewalls (3) along two of the opposite sides. The sidewalls (3) shown are at an angle of approximately 45 degrees to the planar rectangular surface (1). The edges of the sidewalls (3) have a rounded lip (4). One end of the sidewalls (4) is tapered in height. The taper extending from the height of the sidewall to the height of the end of the adjacent side. The adjacent side has a raised lip (4). The height of the raised portion is sufficient to retain fluid in the planar rectangular surface. The other section of the one piece rigid material has a compartment to retain diaper changing accessories. The compartment (2), as shown, is formed as a wall between with the base formed by the planar rectangular surface (1) and the additional sidewalls (3).

The invention is primarily intended for use within the home or apartment where space is limited and where larger and more cumbersome changing tables cannot be used.

The device is used in conjunction with normally used furniture and locations and can be placed on beds, cribs, dressers, tables, kitchen counters, bathroom vanaties, chairs, floors, the ground, or any relatively flat surface.

The device allows the user to easily move the changing station location and the necessary changing accessories to where the infant is located such as a bedroom, kitchen, living room or bathroom. It can also be used to safely move the infant to a more convenient location. It is carried either empty or with the infant securely located in the device.

The device provides at practically any location a sanitary diaper changing container that isolates diaper residue and prevents the diaper residue or other soiling material from coming into contact with surrounding areas (beds, cribs, floors, etc.). Liquid waste, which is occasionally emitted during the changing process and is not soaked by a diaper, is also retained within the changing section by the sidewalls (3), partition and a liquid retaining lip (4).

The device is easily cleaned and kept in a sanitary condition. The one piece, smooth container is nonporous and is readily cleaned and sanitized by a sponge, soap and water. It may also be completely immersed.

The planar rectangular surface (1) keeps the device stable on all relatively stable surfaces. The sidewalls (3) prevent a small infant from rolling or sliding out. The container's smooth molded construction also prevents scratching, pinches or appendage snags while occupied by the infant.

The device may accommodate infants of practically any size since feet and lower legs may extend over the moisture retention lip. (4)

A soft pad (6) made of waterproof material is provided to prevent direct contact to the planar rectangular surface. The pad (6) may be made of foam rubber covered with non-porous vinyl or other suitable material.

Provision for securing the infant safely while changing the diaper or preparing for cleaning up after changing the diaper is made by a safety strap (7). The drawing shows one way of fastening the safety strap, but many other ways of fastening the safety strap may be used. In the drawing a belt or strap (7) is fastened into two slots located in the sidewalls (3). The location of the slots is to hold the pad (6) securely in place and sufficently high to not allow liquid waste to discharge outside the device. The safety strap (7) may pass either over the pad (6) or may pass through the pad (6). The strap (7) is sufficiently long to easily pass around the infant when placed in the rectangular planar surface (1). A standard buckle (7) arrangement consisting of two parts a closed buckle and a buckle with on open end is shown. The open end is opened sufficiently to allow a loop of the other end of the safety strap (5) to pass into the buckle. The loop may be either formed permanently or formed by snaps or material such velcro material.

From the above description it is shown that the present invention provides a device which accomplishes all the objects of the invention and overcomes the disadvantages of previous inventions. While a preferred embodiment of the invention has been described and shown in the drawings above it is understood that changes and modification to the device may be made without departing from the scope and object of the invention.

I claim:

1. A one piece sanitary diaper changing device for use in changing the diapers or other clothing of an infant comprising:

a rigid one piece container having two sections one of the sections having a rectangular flat surface and on two opposite sides sidewalls both sidewalls of sufficient height and at an angle to prevent the infant from rolling or sliding over the edge of the device, the sides of the rectangular flat surface not having the sidewalls have a raised edge that joins with the sidewalls to form a seal to contain liquids on the rectangular flat surface, the other section, is located on one of the sides of the rectangular flat surface not having the sidewalls and has a compartment integrally formed as part of the container; a pad covering the rectangular flat surface; a safety strap located across the rectangular flat surface.

2. A claim as described in claim 1 where the rigid one piece container is made of plastic material.

* * * * *